US010287766B2

(12) United States Patent
Momoe et al.

(10) Patent No.: US 10,287,766 B2
(45) Date of Patent: May 14, 2019

(54) FLUSH TOILET WITH RISING FLOW PATH AND SHELF PORTION

(71) Applicant: TOTO LTD., Kitakyushu-shi, Fukuoka (JP)

(72) Inventors: Masaaki Momoe, Kitakyushu (JP); Shu Kashirajima, Kitakyushu (JP); Masaki Kitamura, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/626,519

(22) Filed: Jun. 19, 2017

(65) Prior Publication Data

US 2017/0370086 A1 Dec. 28, 2017

(30) Foreign Application Priority Data

Jun. 24, 2016 (JP) ..... 2016-125513

(51) Int. Cl.
*E03D 1/26* (2006.01)
*E03D 11/08* (2006.01)

(52) U.S. Cl.
CPC ..... *E03D 11/08* (2013.01); *E03D 1/26* (2013.01)

(58) Field of Classification Search
CPC ..... E03D 11/08; E03D 1/26
USPC ..... 4/420
See application file for complete search history.

(56) References Cited

U.S. PATENT DOCUMENTS 7,661,153 B2 * 2/2010 Nakamura ..... E03D 11/08 4/420
10,030,376 B2 * 7/2018 Kashirajima ..... E03D 11/08 4/420

FOREIGN PATENT DOCUMENTS

JP 2013-044177 A 3/2013

* cited by examiner

*Primary Examiner* — Tuan N Nguyen
(74) *Attorney, Agent, or Firm* — Studebaker & Brackett PC

(57) ABSTRACT

A flush toilet is provided, which can restrain flushing water from excessively flowing down to an inner side of a bowl section before the flushing water reaches an upper end portion of a rising flow path, and can effectively restrain from occurring an unwashed region in the bowl section. A flush toilet of the present invention has a bowl section, and the bowl section forms a water conduit formed between the waste receiving surface and the rim section, and the water conduit includes a shelf portion forming an inclined surface lowering toward an outer side from an inner side of the bowl section, or a horizontal surface formed horizontally toward the outer side from the inner side of the bowl section, in at least a part of a rising flow path rising from a low portion of the water conduit.

5 Claims, 7 Drawing Sheets

FLUSH TOILET WITH RISING FLOW PATH AND SHELF PORTION

TECHNICAL FIELD

The present invention relates to a flush toilet, and particularly relates to a flush toilet that is washed by flushing water supplied from a flushing water source to discharge waste.

BACKGROUND ART

Patent Document 1 (Japanese Published Unexamined Patent Application No. 2013-44177) discloses a conventional flush toilet. In the flush toilet, a rim section is formed to be raised in a substantially vertical direction in order to enhance an impression of cleanliness felt by a user, a water conduit (described as a shelf portion in Patent Document 1) is further formed between a waste receiving surface of a bowl section and the rim section, flushing water discharged onto the conduit from a rim spout port forms a swirl flow and washes the waste receiving surface.

SUMMARY OF THE INVENTION

Technical Problem

However, in the flush toilet as illustrated in Patent Document 1, the water conduit in a front portion of the bowl section is located at a relatively high position between the waste receiving surface and the rim section, so that there arises the problem that when a male user sits and urinates, the user's urine climbs the rim section from the water conduit and exceeds the rim section to flow out of a toilet main body or scatter off. Especially in the flush toilet including a rim section that is formed to be raised in the substantially vertical direction, there arises the problem that urine of the user using the toilet by sitting on the toilet seat easily exceeds the rim section from the water conduit to flow out of the toilet main body.

In this relation, it has been considered to prevent urine from exceeding the rim section to flow out of the toilet main body when a male user sits and urinates by lowering the height of the water conduit in the front portion of the bowl section to a low position.

However, a level difference occurs in the water conduit as a result of the water conduit in the front portion of the bowl section being lowered, and a rising flow path that rises from the water conduit formed in the low position of the front portion of the bowl section is required. Accordingly, in the rising flow path, the force of flushing water is reduced and most of the flushing water with reduced force flows down to the waste receiving surface to cause the problem of generating unwashed regions in the waste receiving surface in the bowl section, the water conduit and the like.

Consequently, the present invention is made to solve the problems of the conventional arts described above, and has an object to provide a flush toilet that can restrain flushing water from excessively flowing down to a side of a waste receiving surface at an inner side of a bowl section before the flushing water reaches an upper end portion of a rising flow path in a water conduit, and can effectively constrain from occurring an unwashed region in the bowl section as a result that the flushing water does not reach the upper end portion of the rising flow path and a flow that flows down to the side of the waste receiving surface from the rising flow path is not formed.

Solution to Problem

In order to attain the aforementioned object, the present invention is a flush toilet that is washed by flushing water supplied from a flushing water source, including a bowl section including a waste receiving surface in a bowl shape, and a rim section forming a vertical wall surface raised substantially upward, a water discharge trap conduit that is connected to a lower portion of the bowl section to discharge waste, and a rim spout port that is provided at the rim section to spout flushing water into the bowl section, wherein the bowl section includes a water conduit formed circumferentially between the waste receiving surface and the rim section, so as to form a swirl flow in the bowl section by the flushing water spouted from the rim spout port, and the water conduit includes a shelf portion forming an inclined surface lowering toward an outer side from an inner side of the bowl section, or a horizontal surface formed horizontally toward the outer side from the inner side of the bowl section, in at least a part of a rising flow path rising from a low portion of the water conduit.

In the present invention configured in this way, in at least a part of the rising flow path of the water conduit, the shelf portion forms the inclined surface lowering toward the outer side from the inner side of the bowl section, or the horizontal surface formed horizontally toward the outer side from the inner side of the bowl section. Thereby, when flushing water conducted in the circumferential direction on the water conduit rises on the rising flow path rising from the low portion of the water conduit, and the force of the flushing water is weakened, the flushing water can be restrained from excessively flowing down to side of the waste receiving surface at the inner side of the bowl section before the flushing water reaches the upper end portion of the rising flow path. Accordingly, the flushing water can be restrained from entirely flowing down to the waste receiving surface in the inner side before the flushing water reaches the upper end portion of the rising flow path, and unwashed regions in the bowl section can be more effectively constrained from occurring as a result that the flushing water does not reach the upper end portion of the rising flow path and a flow that flows down to the side of the waste receiving surface from the rising flow path is not formed.

In the present invention, it is preferable that the shelf portion is an inclined surface lowering toward the outer side from the inner side of the bowl section.

In the present invention configured in this way, in at least a part of the rising flow path of the water conduit, the shelf portion forms the inclined surface lowering toward the outer side from the inner side of the bowl section, so that flushing water can be restrained from excessively flowing down to the side of the waste receiving surface at the inner side of the bowl section before the flushing water reaches the upper end portion of the rising flow path. Accordingly, the flushing water can be restrained from entirely flowing down to the waste receiving surface at the inner side before the flushing water reaches the upper end portion of the rising flow path, and unwashed regions in the bowl section can be more effectively constrained from occurring as a result that the flushing water does not reach the upper end portion of the rising flow path and a flow that flows down to the side of the waste receiving surface from the rising flow path is not formed.

In the present invention, it is preferable that the rim spout port is disposed to spout water rearward in a front side region of the bowl section, and the rising flow path of the water conduit forms a flow path rising from the low portion in a front portion of the bowl section to the rim spout port.

In the present invention configured in this way, in at least a part of the rising flow path of the water conduit, the shelf portion forms the inclined surface lowering toward the outer side from the inner side of the bowl section, or the horizontal surface formed horizontally toward the outer side from the inner side of the bowl section. Thereby, when flushing water conducted in the circumferential direction on the water conduit rises on the rising flow path that rises to the rim spout port from the low portion in the front portion of the bowl section, and the force of the flushing water is weakened, the flushing water can be restrained from excessively flowing down to the side of the waste receiving surface at the inner side of the bowl section before the flushing water reaches the upper end portion of the rising flow path. Accordingly, the flushing water can be restrained from entirely flowing down to the waste receiving surface at the inner side before the flushing water reaches the upper end portion of the rising flow path, and unwashed regions in the bowl section can be more effectively constrained from occurring as a result that the flushing water does not reach the upper end portion of the rising flow path and a flow that flows down to the side of the waste receiving surface from the rising flow path is not formed.

The rim spout port is disposed to spout water rearward, in the front side region of the bowl section, so that the rim spout port is hard to see and not noticeable, as seen from the user standing at the front side of the bowl section. Accordingly, as a result that the rim spout port is made unnoticeable, the user is constrained from concerning stains and the like of the rim spout port, and the bowl section as a whole can easily give beautiful appearance to the user.

In the present invention, it is preferable that the shelf portion of the water conduit is formed from a middle portion of the rising flow path to an upper end portion of the rising flow path.

In the present invention configured in this way, the shelf portion forms the inclined surface lowering toward the outer side from the inner side of the bowl section, or the horizontal surface formed horizontally toward the outer side from the inner side of the bowl section, from the middle portion of the rising flow path to the upper end portion of the rising flow path of the water conduit in which the force of the flushing water is especially weakened, so that the flushing water can be restrained from excessively flowing down to the side of the waste receiving surface at the inner side of the bowl section before the flushing water reaches the upper end portion of the rising flow path.

In the present invention, it is preferable that the shelf portion of the water conduit is formed in a region in a downstream side with respect to a longitudinal axis (an axis extended in the front-to-back direction of the toilet) and in a range of a center angle of 20 degrees to 60 degrees inclusive from the longitudinal axis, when an intersection point of the longitudinal axis that laterally bisects a bowl opening of the bowl section, and a lateral axis (an axis extended in the left-right direction of the toilet) that longitudinally bisects the bowl opening is set as an origin, and the origin is set as a center.

In the present invention configured in this way, the shelf portion forms the inclined surface lowering toward the outer side from the inner side of the bowl section, or the horizontal surface formed horizontally toward the outer side from the inner side of the bowl section, in the region in the range of the center angle of 20 degrees to 60 degrees inclusive from the longitudinal axis, where the force of the flushing water is especially weakened, so that the flushing water can be restrained from excessively flowing down to the side of the waste receiving surface at the inner side of the bowl section before the flushing water reaches the upper end portion of the rising flow path.

Advantageous Effects of the Invention

According to the flush toilet of the present invention, the flushing water can be restrained from excessively flowing down to the side of the waste receiving surface at the inner side of the bowl section before the flushing water reaches the upper end portion of the rising flow path of the water conduit, and unwashed regions in the bowl section can be more effectively constrained from occurring as a result that the flushing water does not reach the upper end portion of the rising flow path and a flow that flows down to the side of the waste receiving surface from the rising flow path is not formed.

DESCRIPTION OF EMBODIMENTS

Next, a flush toilet according to one embodiment of the present invention will be described with reference to FIGS. 1 to 3.

Figure 1:
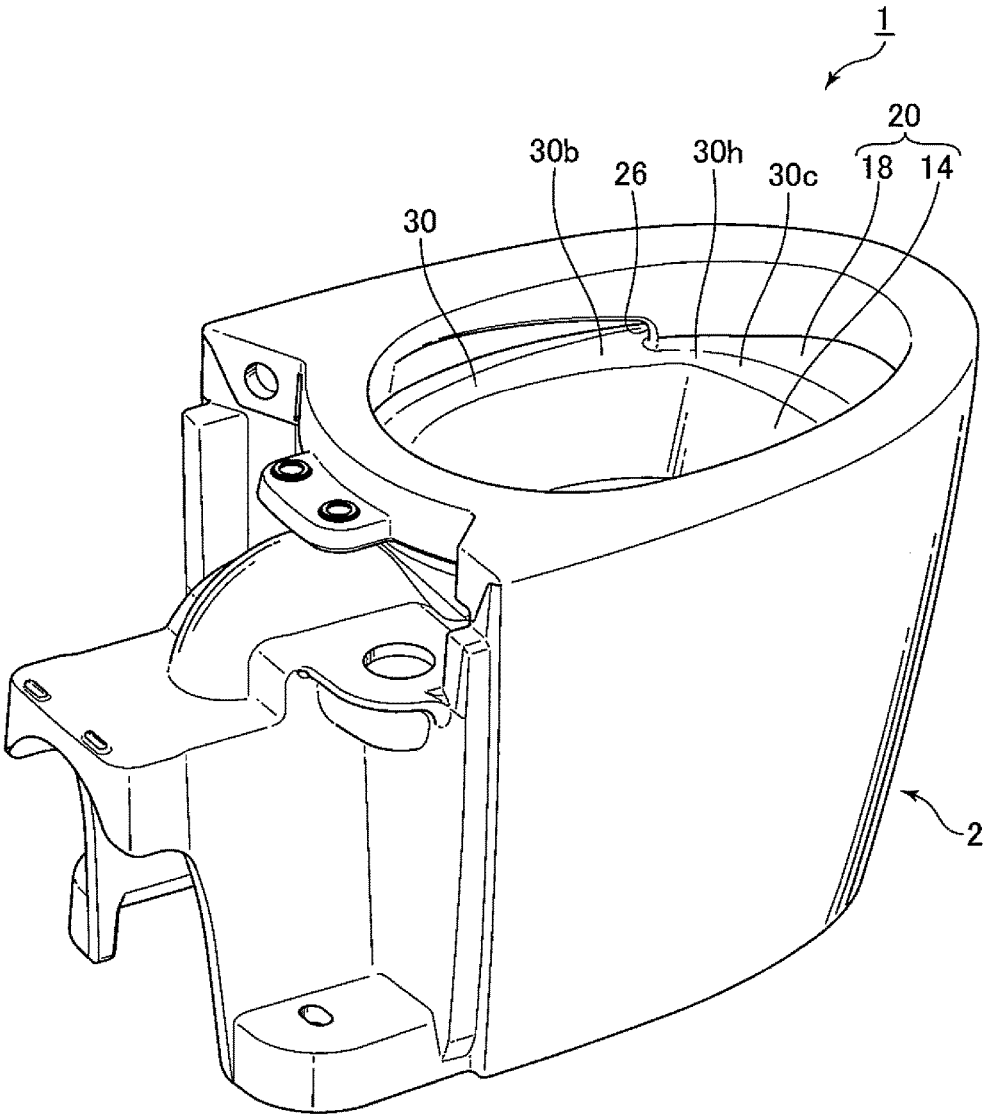
FIG. 1 is a schematic perspective view illustrating a state in which a toilet main body section of a flush toilet according to one embodiment of the present invention is seen from a diagonally rear side.
Figure 2:
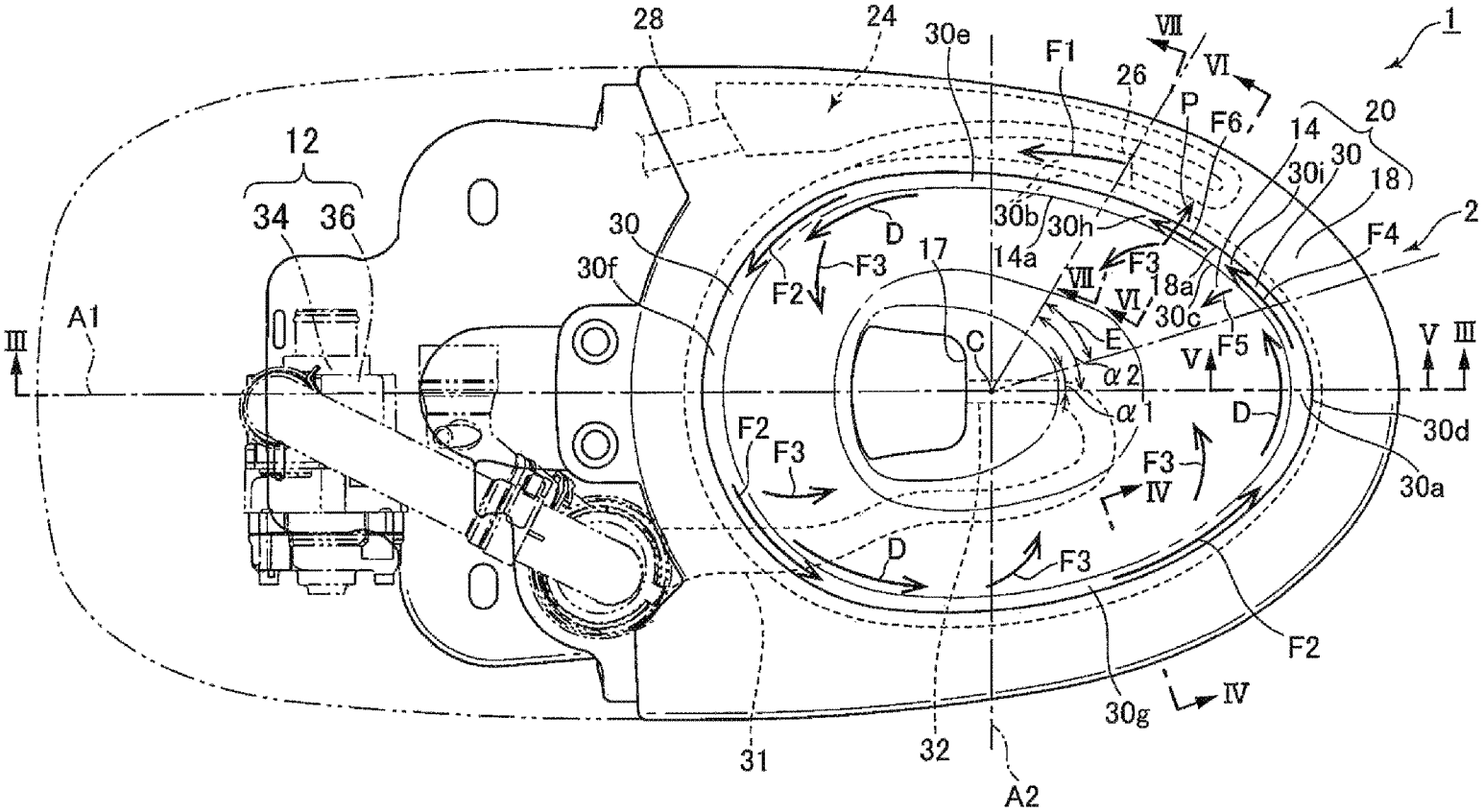
FIG. 2 is a schematic plan view of the flush toilet according to the one embodiment of the present invention illustrated in FIG. 1.
Figure 3:
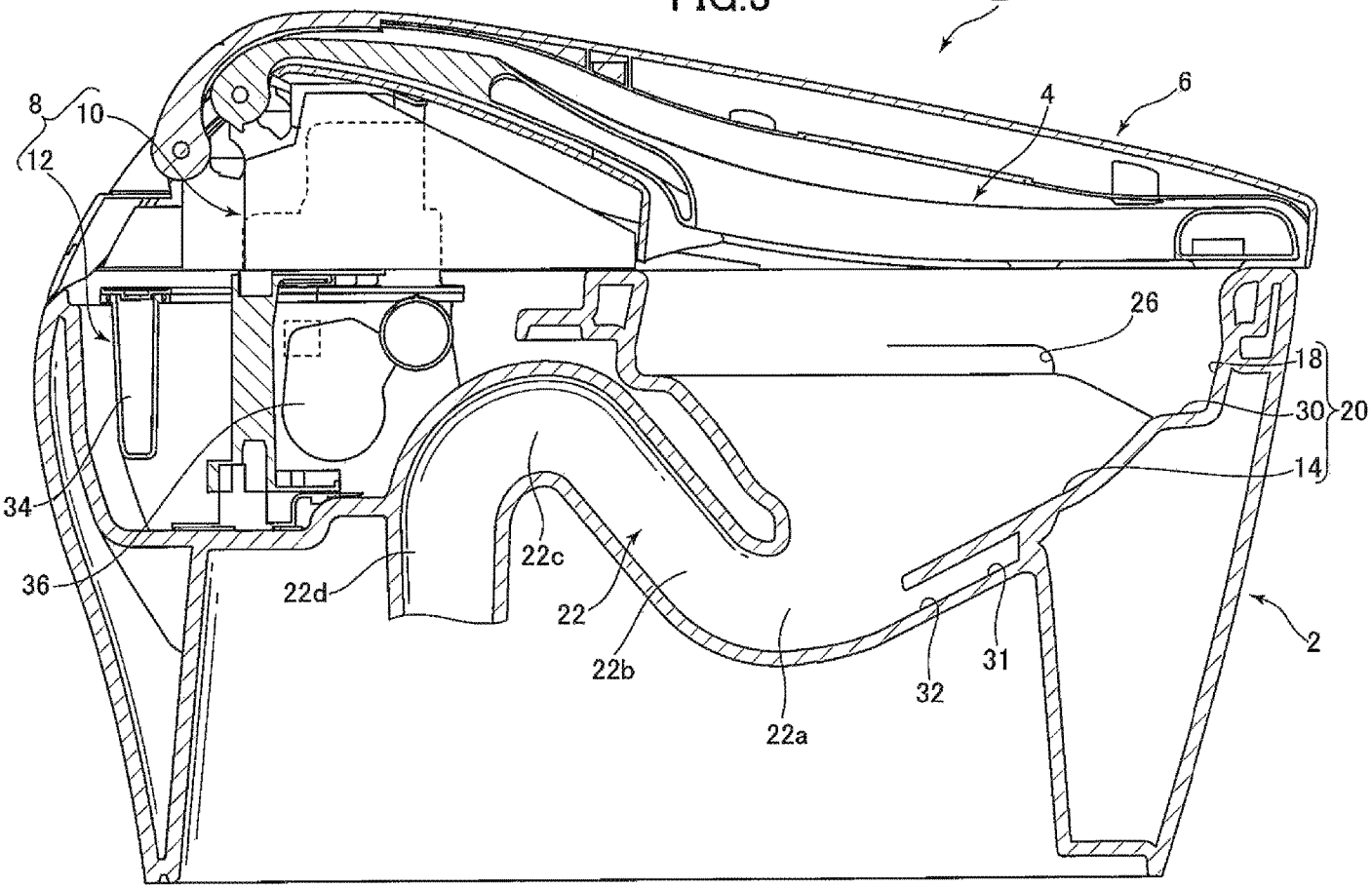
FIG. 3 is a sectional view of a section along a center in a lateral direction in the flush toilet according to the one embodiment of the present invention, seen from a left side, and illustrates a state in which a toilet lid and a toilet seat are turned to a lower position.

As illustrated in FIGS. 1 to 3, a flush toilet 1 according to the one embodiment of the present invention includes a toilet main body 2 made of ceramic, a toilet seat 4 disposed on a top surface of the toilet main body 2 to be capable of turning in a vertical direction, a toilet lid 6 disposed rotatably in the vertical direction to cover the toilet seat 4, and a function section 8 disposed at a rear side of the toilet main body 2.

As illustrated in FIG. 3, the function section 8 includes a sanitary cleaning system function section 10 that cleans private parts of a user, and a water supply system function section 12 for supplying water to the toilet main body 2.

Next, as illustrated in FIGS. 1 to 3, the toilet main body 2 includes a bowl section 20, and the bowl section 20 includes a bowl-shaped waste receiving surface 14, and a rim section 18 forming a vertical wall surface with an inner circumferential surface of the rim section 18 raised substantially upward above the waste receiving surface 14.

Further, as illustrated in FIG. 3, the toilet main body 2 includes a water discharge trap conduit 22 that discharges waste in the bowl section 20, and an inlet portion 22*a* of the water discharge trap conduit 22 is connected to a lower side of the bowl section 20.

As illustrated in FIG. 2, in the bowl section 20, a rim water path 24 is formed inside the rim section 18 in a right side of a front part of the toilet main body 2.

An upstream side of the rim water path 24 is connected to a water conduit 28 that conducts flushing water, and the water conduit 28 is directly connected to city water utility (not illustrated) that is a flushing water source. Further, a rim spout port 26 that is a part of a rim spout port (spout portion) is formed in a downstream end of the rim water path 24. In this way, by using pressure of water supply of city water utility, flushing water that is supplied into the rim water path 24 from the water conduit 28 is conducted forward in the rim water path 24, and thereafter, bends inward and rearward to be conducted to the rim spout port 26 in a downstream side.

The rim spout port 26 may be disposed in a position in a left side of the front part, a position in a right side of a rear part, or a position in a left side of the rear part, of the toilet main body 2. For example, the rim spout port may be disposed in a position at a left side of a rear part of the bowl section 20, and may spout water onto the water conduit toward a front side. Further, the rim spout port 26 may be disposed at two spots in the bowl section 20. For example, the rim spout port may be formed by a first rim spout port in the left side of the rear part of the bowl section 20, and a second rim spout port in a right side of the rear part of the bowl section 20.

As illustrated in FIG. 3, a jet spout port 32 that is opened to be directed to the inlet portion 22*a* of the water discharge trap conduit 22 is formed in a lower portion of the bowl section 20. The jet spout port 32 forms a spout port for spouting a jet flow. The jet spout port 32 is formed in a downstream end portion of the jet water conduit 31 extending from a water storage tank 34. The jet water conduit 31 is connected to the water storage tank 34 via a pressure pump 36. The flushing water stored in the water storage tank 34 is pressurized by the pressure pump 36 and is spouted from the jet spout port 32.

Further, the flushing water spouted from the jet spout port 32 flows into a rising conduit 22*b* in a rear side of the inlet portion 22*a* from the inlet portion 22*a* of the water discharge trap conduit 22, and thereafter flows in the rising conduit 22*b* to flow out to a lowering conduit 22*d* from a top portion 22*c* of the water discharge trap conduit 22.

When a water supply using water utility direct pressure supply is adopted as a supply water source for supplying flushing water to the jet water conduit 31, the pressure pump 36 may be omitted, because water that is pressurized by supply water pressure of city water utility is supplied.

Here, detailed explanation of respective specific structures of the sanitary cleaning system function section 10 and the water supply system function section 12 will be omitted, since the specific structures thereof are similar to the conventional ones. The water supply system function section 12 is provided with a controller or the like that controls an on/off operation of an electromagnetic valve, a switching operation of a changeover valve, and a number of revolutions, an operating time period and the like of the pressure pump.

The flush toilet 1 according to the present embodiment is a hybrid type flush toilet, which performs rim water spout by the rim spout port 26 by using water supply pressure of city water, and supplies flushing water in the water storage tank 34 by controlling the pressure pump 36 for jet water spout by the jet spout port 32. The flush toilet may switch the flushing water from city water to rim water spout by the rim spout port 26 and jet water spout by the jet spout port 32 by switching a valve. Further, the flush toilet may switch the flushing water which is supplied from the water storage tank to rim water spout by the rim spout port 26 and jet water spout by the jet spout port 32.

Next, with reference to FIGS. 2 to 7, a detailed structure of a water conduit 30 of the flush toilet 1 according to the one embodiment of the present invention will be described.

The bowl section 20 forms the water conduit 30 between the waste receiving surface 14 and the rim section 18. The water conduit 30 is for conducting flushing water which is spouted from the rim spout port 26, in a circumferential direction to cause the flushing water to form a swirl flow in the bowl section 20.

The water conduit 30 is connected to an upper end portion 14*a* of an outer edge of the waste receiving surface 14, and is connected to a lower end portion 18*a* of an inner edge of the rim section 18. The water conduit 30 configures a ring-shaped circling flow path. The water conduit 30 is formed so that most of an entire circumference thereof has substantially the same height. In a front portion of the bowl section 20, a low portion 30*a* that is in a lower position than height positions of other portions is formed. The lower end portion 18*a* of the rim section 18 in the low portion 30*a* is formed in a lower position than the lower end portion 18*a* of the rim section 18 in other regions, and is formed in the lowest position.

Figure 4:
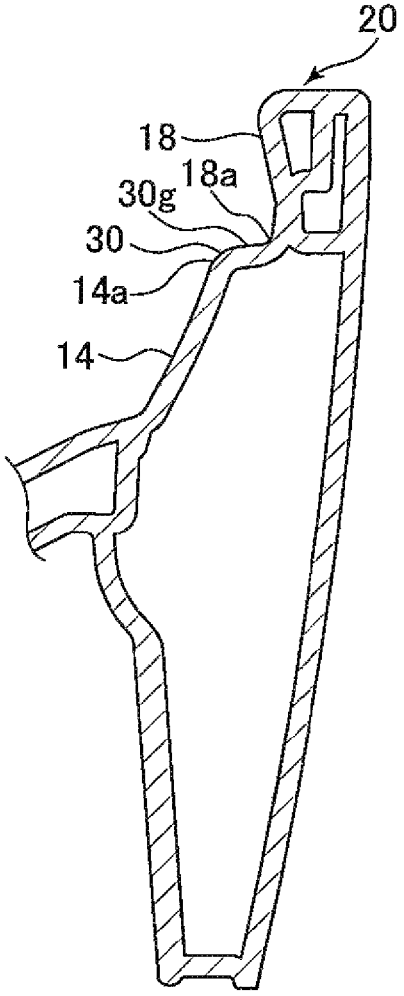
FIG. 4 is a sectional view taken along line IV-IV in FIG. 2.
Figure 5:
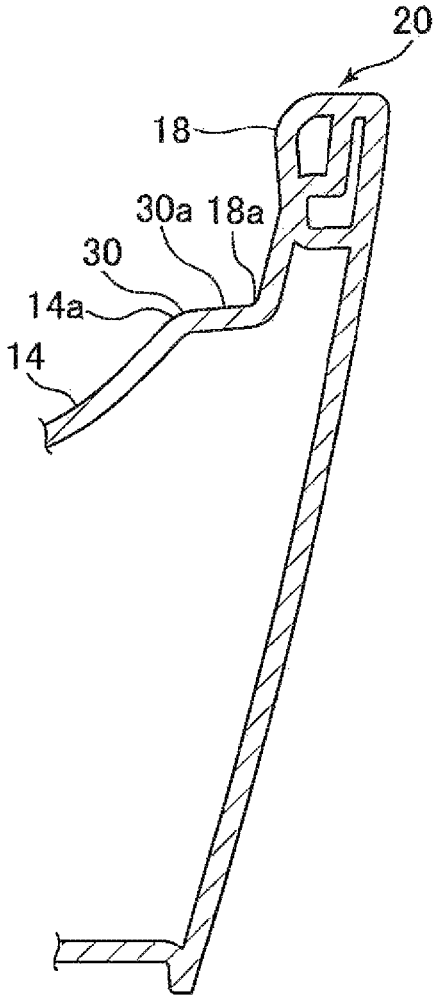
FIG. 5 is a sectional view taken along line V-V in FIG. 2.
Figure 6:
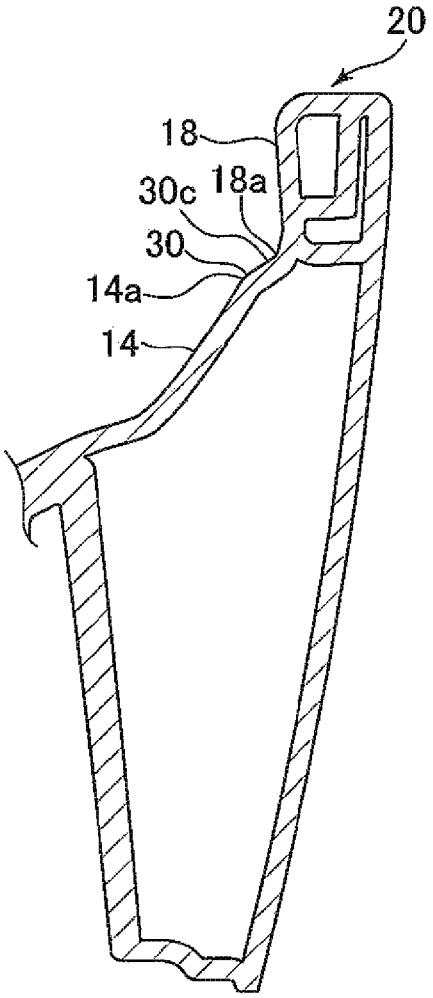
FIG. 6 is a sectional view taken along line VI-VI in FIG. 2.

As illustrated in FIGS. 4 to 6, the water conduit 30 forms a relatively flat surface that lowers slightly inward from the lower end portion 18*a* of the rim section 18 to the upper end portion 14*a* of the waste receiving surface 14, in most of the regions. Most of the water conduit 30 except for the low portion 30*a* and an inclined flow path to the low portion 30*a* is formed to be at the same height as a height of the rim spout port 26. The water conduit 30 forms a surface close to horizontal, between the rim section 18 and the waste receiving surface 14. Accordingly, flushing water can flow in such a manner as to circle on the water conduit 30. Flushing water gradually flows down to the waste receiving surface 14 toward an inner side while circling on the water conduit 30, and thereby forms a swirl flow that spirally converges to a center of the waste receiving surface 14.

The rim spout port 26 is connected to a spout port vicinity portion 30*b* in an orientation along a tangential line of the spout port vicinity portion 30*b* of the water conduit 30. Thereby, the flushing water spouted from the rim spout port 26 forms a circling flow on the water conduit 30 in a direction circling on the water conduit 30.

The low portion 30*a* of the water conduit 30 is formed at a lower position than the height of the rim spout port 26. The low portion 30*a* of the water conduit 30 is disposed at a height lower than heights of other positions of the water conduit 30, for example, the positions of the spout port vicinity portion 30*b*, a rear portion 30*f* and a left front portion 30*g* of the water conduit 30. Therefore, the low portion 30*a* of the water conduit 30 forms a lowest portion of the water conduit 30.

In the front portion of the bowl section 20, the height position of the low portion 30*a* of the water conduit 30 is formed at a relatively low position, whereby when a user urinates while sitting on the toilet seat 4, the urine can be constrained from colliding with the water conduit 30 to flow along the rim section 18 raised upright to flow outside the toilet main body 2 or scatter off. Further, the urine can be constrained from being lifted by the water conduit 30 and hitting the user.

Since the water conduit 30 has the low portion 30*a*, a lowering flow path portion heading to the low portion 30*a* from the left front portion 30*g* side, and a rising flow path 30*c* portion heading to the spout port vicinity portion 30*b* from the low portion 30*a* are formed in the water conduit 30.

The water conduit 30 forms a normal inclined surface that substantially lowers to an inner side from an outer side of the bowl section 20, in a region from the rim spout port 26 to the low portion 30*a* of the water conduit 30 along a water spout direction of the rim spout port 26. A perpendicular line of the normal inclined surface like this extends toward an inner side of the toilet main body 2. The spout port vicinity portion 30*b*, the rear portion 30*f* and the left front portion 30*g* of the water conduit 30 each forms a normal inclined surface. The water conduit 30 forms a normal inclined surface, and thereby a part of flushing water gradually flows down to the waste receiving surface 14 at a lower side as the flushing water circles on the water conduit 30.

The rising flow path 30*c* of the water conduit 30 is formed on all or a part of a range from the front end region to a right side region of the bowl section 20. The rising flow path 30*c* of the water conduit 30 extends to a right side portion 30*e* from a front end portion 30*d* of the water conduit 30.

A shelf portion 30*h* is formed on an upper side portion that is at least a part of the rising flow path 30*c* of the water conduit 30, and the shelf portion 30*h* forms an inclined surface that lowers toward an outer side from the inner side of the bowl section 20, or a horizontal surface formed horizontally toward the outer side from the inner side of the bowl section 20.

The shelf portion 30*h* of the water conduit 30 is formed from a middle portion 30*i* of the rising flow path 30*c* to the rim spout port vicinity portion 30*b* at the upper end portion. The shelf portion 30*h* of the water conduit 30 can be formed in all or a part of the rising flow path 30*c*, and may be formed only in the vicinity of the rim spout port 26 at the upper end portion, for example. The shelf portion 30*h* of the water conduit 30 is formed to include a region of the spout port vicinity portion 30*b* at an inner side of the rim spout port 26. In a region from the low portion 30*a* at the lower end portion of the rising flow path 30*c* to the middle portion 30*i*, the shelf portion 30*h* is not formed, and the rising flow path 30*c* forms a normal inclined surface that lowers toward the inner side from the outer side of the bowl section 20.

Figure 7:
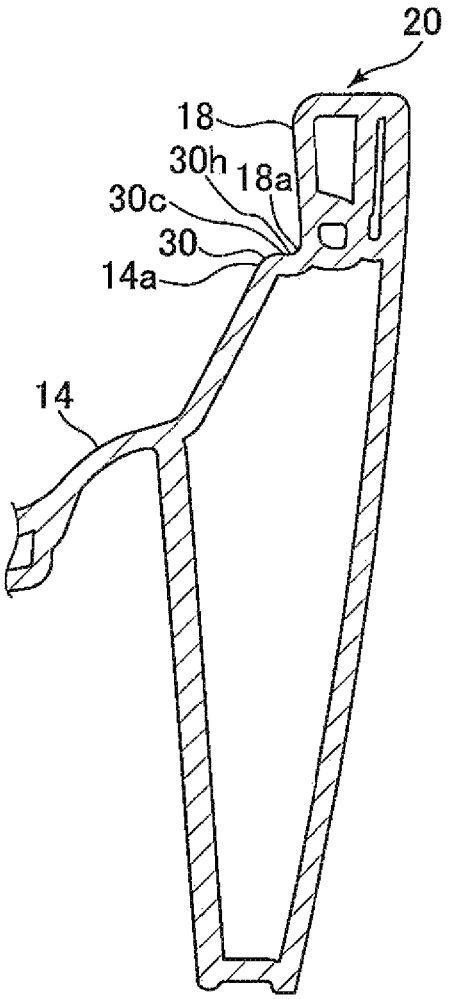
FIG. 7 is a sectional view taken along line VII-VII in FIG. 2.

As illustrated in FIG. 7, the shelf portion 30*h* of the water conduit 30 forms a reverse inclined surface that lowers toward the outer side from the inner side of the bowl section 20. The reverse inclined surface of the shelf portion 30*h* is formed in such a manner that an inclination to the outer side becomes larger as the shelf portion 30*h* rises from a start portion of the shelf portion 30*h*, and in a vicinity of an upper end portion thereof, the reverse inclination gradually becomes smaller as the shelf portion 30*h* rises to return to horizontal. A perpendicular line of the reverse inclined surface extends to the outer side of the toilet main body. Therefore, the upper end portion 14*a* of the waste receiving surface 14 is disposed in a position higher than the lower end portion 18*a* of the rim section 18. The flushing water flowing on the shelf portion 30*h* tends to draw near the outer side of the toilet main body 2, that is, the rim section 18 side.

The shelf portion 30*h* of the water conduit 30 may form a horizontal surface that is formed substantially horizontally toward the outer side from the inner side of the bowl section 20. In this case, a perpendicular line of the horizontal surface of the shelf portion 30*h* is directed upward in the vertical direction, which is different from that of the normal inclined surface. Therefore, the upper end portion 14*a* of the waste receiving surface 14 is disposed at the same height as the lower end portion 18*a* of the rim section 18. When the shelf portion 30*h* of the water conduit 30 forms a horizontal surface, flushing water flowing on the shelf portion 30*h* hardly draws near the inner side or the outer side of the toilet main body 2, and keeps a direction, velocity and the like of the flow of its own. Therefore, even when the force of flushing water is weakened in the upper side of the rising flow path 30*c*, it can be also made difficult for the flushing water to flow down to the side of the waste receiving surface 14, and the flushing water can be conducted to the downstream side while the flushing water is kept on the shelf portion 30*h*.

An intersection point of a longitudinal axis A1 that laterally bisects a bowl opening of the bowl section 20 and a lateral axis A2 that longitudinally bisects the bowl opening is set as an origin (a center point) C. The shelf portion 30*h* of the bowl section 20 is formed in a region E that is in a downstream side with respect to the longitudinal axis A1 and in a range of a center angle $\alpha 1$ degrees to $\alpha 2$ degrees inclusive from the longitudinal axis A1, with the origin C set as a center. For example, $\alpha 1$ degrees is 20 degrees, and $\alpha 2$ degrees is 60 degrees.

The upper end of the rising flow path 30*c* of the water conduit 30 is formed in the spout port vicinity portion 30*b*, so that when a small amount of remaining water leaks out from the rim spout port 26 after water spout from the rim spout port 26 is finished, the flushing water which flows out flows down to the rising flow path 30*c* of the water conduit 30. The flushing water can flow down toward the low portion 30*a* along the shelf portion 30*h* in the rising flow path 30*c*, and can flow down to the waste receiving surface 14 from the low portion 30*a* forming the normal inclined surface oriented inward.

In addition, when the force of the flushing water is weakened after end of water spout from the rim spout port 26, and the like, and flushing water that cannot sufficiently climb the rising flow path 30*c* occurs, the flushing water is collected at the outer side along the reverse inclined surface of the shelf portion 30*h* and can flow down toward the low portion 30*a* along the rising flow path 30*c*. In this way, even when flushing water that cannot sufficiently climb the rising flow path 30*c* occurs, the flushing water can be caused to flow down toward the low portion 30*a* along the rising flow path 30*c* without being kept in the shelf portion 30*h*. Furthermore, the low portion 30*a* forms the normal inclined surface oriented inward, so that the flushing water can flow down to the waste receiving surface 14 from the low portion 30*a*.

Next, with reference to FIGS. 1 to 5, an operation (action) of the flush toilet according to the one embodiment of the present invention will be described.

When a user presses an operation button (not illustrated) for washing stool, for example, after using the toilet, a signal from the operation button (not illustrated) is transmitted to the controller (not illustrated), and a washing operation for washing stool of the flush toilet 1 is started.

When the user operates the operation button (not illustrated), the controller allows flushing water to pass through the water conduit 28, and the rim water path 24 from the water supply source such as city water, and spouts the flushing water from the rim spout port 26.

The flushing water spouted from the rim spout port 26 flows downward while swirling in the bowl section 20 to wash an inner wall surface of the bowl section 20.

The flushing water spouted from the rim spout port 26 is spouted onto the spout port vicinity portion 30*b* of the water conduit 30 from the rim spout port 26 as shown by an arrow F1. As shown by an arrow F2, the flushing water spouted from the rim spout port 26 forms a circling flow (a swirl flow) on the water conduit 30 in an orientation (in an orientation in a circling direction D) circling on the water conduit 30. At this time, as shown by an arrow F3, the flushing water gradually flows down to the waste receiving surface 14 in the inner side, and thereby forms a swirl flow that converges to the center of the waste receiving surface 14, in a spiral shape.

As shown by an arrow F4, the flushing water passing through the low portion 30*a* of the water conduit 30 rises in the orientation in the circling direction D on the rising flow path 30*c* of the water conduit 30. At this time, the flushing water rises on the rising flow path 30*c*, and therefore the force and the flow velocity of the flushing water gradually decrease. Since the normal inclined surface is formed in the region from the low portion 30*a* of the rising flow path 30*c* to the middle portion 30*i*, a part of the flushing water swirling on the water conduit 30 easily flows down onto the waste receiving surface 14 at the inner side, as shown by an arrow F5.

As shown by an arrow F6, when the flushing water reaches the shelf portion 30*h* of the rising flow path 30*c*, the flushing water can be restrained from flowing down to the side of the waste receiving surface 14 at the inner side from the shelf portion 30*h*, because the shelf portion 30*h* forms the inclined surface lowering toward the outer side from the inner side of the bowl section 20 or a horizontal surface.

Specifically, since the shelf portion 30*h* forms the reverse inclined surface, the flushing water flowing on the shelf portion 30*h* receives a force P that causes the flushing water to draw near to the rim section 18. Accordingly, the flushing water flowing on the shelf portion 30*h* hardly flows down and is restrained from flowing down from side of the upper end portion 14*a* of the waste receiving surface 14, even when the amount of flushing water is reduced, the water force is weakened, or the flow velocity of the water flow is dropped. The amount of flushing water that flows down to the side of the upper end portion 14*a* of the waste receiving surface 14 from the shelf portion 30*h* is restrained, so that the amount of flushing water that flows down to the side of the upper end portion 14*a* of the waste receiving surface 14 from the shelf portion 30*h* can be reduced to a relatively small amount. Therefore, the flushing water can be restrained from excessively flowing down to the side of the waste receiving surface 14 before the flushing water reaches the upper end portion of the rising flow path 30*c*. Further, the flushing water is restrained from entirely flowing down to the waste receiving surface 14 at the inner side before the flushing water reaches the upper end portion of the rising flow path 30*c*. Consequently, the flushing water is caused to reach the upper end portion of the rising flow path 30*c* and the flow flowing down to the side of the waste receiving surface 14 from the rising flow path 30*c* can be formed in a relatively wide range over substantially the entire rising flow path 30*c*.

In this way, flows that flow down to the side of the waste receiving surface 14 in a relatively wide range can be formed also from the water conduit 30 at the upper portion passed the rising flow path 30*c*, or the water conduit at a portion passing through the rising flow path 30*c*. Further, flushing water can be restrained from flowing down to the side of the upper end portion 14*a* of the waste receiving surface 14 also in the upper end portion (the spout port vicinity portion 30*b* immediately before the rim spout port 26) of the rising flow path 30*c* in which the force and the flow velocity of the flushing water that has circled on the water conduit 30 tend to be the weakest. Therefore, the flushing water can be circled to the spout port vicinity portion 30*b*, on the water conduit 30.

Consequently, the flushing water can be restrained from entirely flowing down to the waste receiving surface 14 at the inner side before the flushing water reaches the upper end portion of the rising flow path 30*c*. Therefore, unwashed regions on the water conduit 30 can be more effectively restrained from occurring as a result that the flushing water flowing on the water conduit 30 cannot reach the upper end portion of the rising flow path 30*c* and flows down. Further, unwashed regions can be more effectively restrained from occurring on the waste receiving surface 14 as a result that the flushing water cannot reach the upper end portion of the rising flow path 30*c* to cause bias to the swirl flow formed on the waste receiving surface 14.

When flushing water reaches a front surface side of the rim spout port 26 at the spout port vicinity portion 30*b*, flow that is to circle on the water conduit 30 is further formed, coupled with the flow (refer to the arrow F1) of the flushing water spouted from the rim spout port 26.

Flushing water gradually flows down to the waste receiving surface 14 at the inner side while circling on the water conduit 30, and forms a swirl flow that converges to the center of the waste receiving surface 14. In the region of the shelf portion 30*h* of the rising flow path 30*c*, flushing water can be restrained from excessively flowing down to the side of the waste receiving surface 14. Accordingly, the entire waste receiving surface 14 can be washed uniformly so that no unwashed region is generated, by flushing water that is caused to flow down relatively uniformly from the entire circumference of the water conduit 30.

The flushing water flowing down to the waste receiving surface 14 is caused to flow down to the water storage portion 17, and flows into the water discharge trap conduit 22. Almost simultaneously, the flushing water spouted from the jet spout port 32 by the pressure pump 36 operated by the controller flows into the water discharge trap conduit 22, and fills the water discharge trap conduit 22 to cause a siphon phenomenon. By the siphon phenomenon, staying water and waste in the bowl section 20 are sucked into the water discharge trap conduit 22, and are discharged from a drain pipe (not illustrated) in a downstream side.

After a predetermined time period lapses after flushing water is supplied to the toilet main body 2, the controller (not illustrated) ends water spout from the rim spout port 26, stops the operation of the pressure pump 36, and stops water spout from the jet spout port 32 to end a series of washing operation.

Next, an operation in the flush toilet 1 according to the one embodiment of the present invention described above will be described.

First, according to the flush toilet 1 according to the present embodiment, in at least a part of the rising flow path 30*c* of the water conduit 30, the shelf portion 30*h* forms the inclined surface lowering toward the outer side from the inner side of the bowl section 20, or the horizontal surface formed horizontally toward the outer side from the inner side of the bowl section 20. Thereby, when flushing water conducted in the circumferential direction on the water conduit 30 rises on the rising flow path 30*c* rising from the low portion 30*a* of the water conduit 30, and the force of the flushing water is weakened, the flushing water can be restrained from excessively flowing down to the side of the waste receiving surface 14 at the inner side of the bowl section 20 before the flushing water reaches the upper end portion of the rising flow path 30*c*. Accordingly, the flushing water can be restrained from entirely flowing down to the waste receiving surface 14 in the inner side before the flushing water reaches the upper end portion of the rising flow path 30*c*, and unwashed regions in the bowl section 20 can be more effectively constrained from occurring as a result that the flushing water does not reach the upper end portion of the rising flow path 30*c* and a flow that flows down to the side of the waste receiving surface 14 from the rising flow path 30*c* is not formed.

Next, according to the flush toilet 1 according to the present embodiment, in at least a part of the rising flow path 30*c* of the water conduit 30, the shelf portion 30*h* forms the inclined surface that lowers toward the outer side from the inner side of the bowl section 20, so that flushing water can be restrained from excessively flowing down to the side of the waste receiving surface 14 at the inner side of the bowl section 20 before the flushing water reaches the upper end portion of the rising flow path 30*c*. Accordingly, the flushing water can be restrained from entirely flowing down to the waste receiving surface 14 at the inner side before the flushing water reaches the upper end portion of the rising flow path 30*c*, and unwashed regions in the bowl section 20 can be more effectively constrained from occurring as a result that the flushing water does not reach the upper end portion of the rising flow path 30*c* and a flow that flows down to the side of the waste receiving surface 14 from the rising flow path 30*c* is not formed.

Further, according to the flush toilet 1 according to the present embodiment, in at least a part of the rising flow path 30*c* of the water conduit 30, the shelf portion 30*h* forms the inclined surface lowering toward the outer side from the inner side of the bowl section 20, or the horizontal surface formed horizontally toward the outer side from the inner side of the bowl section 20. Thereby, when flushing water conducted in the circumferential direction on the water conduit 30 rises on the rising flow path 30*c* that rises to the rim spout port 26 from the low portion 30*a* in the front portion of the bowl section 20, and the force of the flushing water is weakened, the flushing water can be restrained from excessively flowing down to the side of the waste receiving surface 14 at the inner side of the bowl section 20 before the flushing water reaches the upper end portion of the rising flow path 30*c*. Accordingly, the flushing water can be restrained from entirely flowing down to the waste receiving surface 14 at the inner side before the flushing water reaches the upper end portion of the rising flow path 30*c*, and unwashed regions in the bowl section 20 can be more effectively constrained from occurring as a result that the flushing water does not reach the upper end portion of the rising flow path 30*c* and a flow that flows down to the side of the waste receiving surface 14 from the rising flow path 30*c* is not formed.

The rim spout port 26 is disposed to spout water rearward, in the front side region of the bowl section 20, so that the rim spout port 26 is hard to see and not noticeable, as seen from the user standing at the front side of the bowl section 20. Accordingly, as a result that the rim spout port 26 is made unnoticeable, the user is constrained from concerning stains of the rim spout port 26, and the bowl section 20 as a whole can easily give beautiful appearance to the user.

Further, according to the flush toilet 1 according to the present embodiment, the shelf portion 30*h* forms the inclined surface lowering toward the outer side from the inner side of the bowl section 20, or the horizontal surface formed horizontally toward the outer side from the inner side of the bowl section 20, from the middle portion of the rising flow path 30*c* to the upper end portion of the rising flow path 30*c* of the water conduit 30 in which the force of the flushing water is especially weakened, so that the flushing water can be restrained from excessively flowing down to the side of the waste receiving surface 14 at the inner side of the bowl section 20 before the flushing water reaches the upper end portion of the rising flow path 30*c*.

Furthermore, according to the flush toilet 1 according to the present embodiment, the shelf portion 30*h* forms the inclined surface lowering toward the outer side from the inner side of the bowl section 20, or the horizontal surface formed horizontally toward the outer side from the inner side of the bowl section 20, in the region in the range of the center angle of 20 degrees to 60 degrees inclusive from the longitudinal axis A1 where the force of the flushing water is especially weakened, so that the flushing water can be restrained from excessively flowing down to the side of the waste receiving surface 14 at the inner side of the bowl section 20 before the flushing water reaches the upper end portion of the rising flow path 30*c*.

What is claimed is:

1. A flush toilet that is washed by flushing water supplied from a flushing water source, comprising:

a bowl section including a bowl-shaped waste receiving surface, and a rim section forming a wall surface raised substantially upward;

a water discharge trap conduit that is connected to a lower portion of the bowl section to discharge waste; and a rim spout port that is provided at the rim section to spout flushing water into the bowl section, wherein the bowl section includes a water conduit formed circumferentially between the waste receiving surface and the rim section, so as to form a swirl flow in the bowl section by the flushing water spouted from the rim spout port, and wherein the water conduit includes a rising flow path rising from a low portion of the water conduit toward a downstream side in a swirl direction of the swirl flow, wherein the rising flow path includes a shelf portion in at least a part of the rising flow path:

the shelf portion forming an inclined surface lowering from an inner side of the bowl section toward an outer side of the bowl section, or the shelf portion forming a horizontal surface formed horizontally from the inner side of the bowl section toward the outer side.

2. The flush toilet according to claim 1, wherein the shelf portion is an inclined surface lowering from the inner side toward the outer side.

3. The flush toilet according to claim 1, wherein the rim spout port is disposed to spout water rearward in a front side region of the bowl section, and the rising flow path of the water conduit forms a flow path rising from the low portion in a front portion of the bowl section to the rim spout port.

4. The flush toilet according to claim 1, wherein the shelf portion of the water conduit is formed from a middle portion of the rising flow path to an upper end portion of the rising flow path.

5. The flush toilet according to claim 1, wherein an intersection point of a longitudinal axis that laterally bisects a bowl opening of the bowl section, and a lateral axis that longitudinally bisects the bowl opening is defined as an origin, the shelf portion of the water conduit is formed in a region in a front side of the lateral axis and in a downstream side of the longitudinal axis and a region in a range from 20 degrees to 60 degrees from the longitudinal axis centered on the origin.

* * * * *